US007640859B1

(12) United States Patent
Hines

(10) Patent No.: US 7,640,859 B1
(45) Date of Patent: Jan. 5, 2010

(54) STACKED ORDNANCE

(76) Inventor: Steve Hines, P.O. Box 423, Tijeras, NM (US) 87059

( * ) Notice: Subject to any disclaimer, the term of this patent is extended or adjusted under 35 U.S.C. 154(b) by 478 days.

(21) Appl. No.: 11/789,510

(22) Filed: Apr. 24, 2007

(51) Int. Cl.
*F42C 15/44* (2006.01)
*F42C 15/42* (2006.01)

(52) U.S. Cl. ..... 102/426; 102/427; 102/428; 42/84

(58) Field of Classification Search ..... 102/416, 102/417, 418, 424, 425, 426, 427, 428, 429; 42/84
See application file for complete search history.

(56) References Cited

U.S. PATENT DOCUMENTS 30,332 A 10/1860 Lindsay
3,815,271 A * 6/1974 Lynn ..... 42/84
3,854,231 A 12/1974 Broyles ..... 42/84
5,133,260 A * 7/1992 Grosch ..... 102/401
6,715,398 B2 4/2004 O'Dwyer ..... 89/135
7,451,702 B1 * 11/2008 Dindl et al. ..... 102/472

* cited by examiner

*Primary Examiner*—Stephen M Johnson
(74) *Attorney, Agent, or Firm*—Richard H. Krukar; Luis M. Ortiz; Kermit D. Lopez

(57) ABSTRACT

A stacked ordnance device provides a disposable and non reusable projectile weapon for passive area defense or denial. A stacked ordnance device has multiple projectiles and charges positioned sequentially in a barrel. A sensing module triggers a control module to enter a firing sequence. The firing sequence is the order and timing by which an electronic ignition system ignites firing charges and thereby shoots the projectiles. A mount positions the stacked ordnance device. The controller can also trigger a disabler that renders the stacked ordnance device unfit for subsequent use.

20 Claims, 3 Drawing Sheets

STACKED ORDNANCE

TECHNICAL FIELD

Embodiments relate to the fields of firearms, small arms, mines, and sensors. Embodiments also relate to electronically fired ordnance and to multiple projectiles simultaneously loaded in a barrel. Embodiments further relate to non-lethal projectiles, pepper balls, and bean bags.

BACKGROUND

Stacked projectile firearms have been developed and tested for almost as long as firearms have existed. The concept was of interest to muzzle loaders because it provided for multiple firings between reloadings. More recently, interest has been rekindled because the concept provides for firearms with few, if any, moving parts and with very high rates of fire.

Stacked projectile firearms were developed before breech loading firearms were. Breach loading firearms include bolt action, revolver, semiautomatic, and automatic firearms. The stacked projectile firearms, however, were inferior for a number of reasons. They are hard to reload because each projectile in the stack must be precisely positioned. Initial discharges tended to compact subsequent loads and thereby change firing characteristics. Initial discharges could feed back into subsequent loads and cause a chain firing or explosive condition. These, and other factors, led to stacked projectile firearms being less reliable than breach loading firearms. Recent developments have addressed the reliability issues.

In military applications, projectile weapons such as firearms are typically used for actively defense or for attack. Stationary explosive munitions such as mines, however, are typically used for passive defense. Herein, "active" indicates that a person is directly involved in targeting and firing. "Passive" indicates that a person is not currently actively engaged. As such, a force encountering projectile weapons reacts far differently than a force encountering stationary explosive munitions. Systems and methods for employing projectile weapons to passive defense are needed.

BRIEF SUMMARY

The following summary is provided to facilitate an understanding of some of the innovative features unique to the embodiments and is not intended to be a full description. A full appreciation of the various aspects of the embodiments can be gained by taking the entire specification, claims, drawings, and abstract as a whole.

Systems and methods providing a stacked ordnance firearm for passive area defense are needed.

It is therefore an aspect of the embodiments to provide a stacked ordnance barrel assembly that includes an electronic ignition system and a barrel loaded with many projectiles and firing charges for firing the charges out of the barrel. The ignition system ignites the firing charges. The projectiles can be lethal such as bullets, sabots, or masses of pellets. The projectiles can also be non-lethal such as pepper balls, bean bags, and rubber bullets. Those practiced in the art of projectiles are familiar with bullets, sabots, masses of pellets (shotgun load), pepper balls, bean bags, and rubber bullets.

It is also an aspect of the embodiments to provide a mount. The mount sets the barrel assembly into position for directing the projectiles in an advantageous direction.

It is yet another aspect of the embodiments to provide a disabler. The disabler renders the stacked ordnance barrel assembly unfit for further use or reuse.

It is an additional aspect of the embodiments to provide a control module that causes the firing charges to ignite at the proper time and in a desired sequence. The desired sequence is that the forward firing charge is ignited before subsequent ones. The proper time can be determined based on external stimulus, a timed firing sequence, or both. The control module also activates the disabler at an appropriate time.

It is a further aspect of the embodiments to provide a sensing module. The sensing module detects at least one stimulus and triggers the control module to enter a firing sequence or activate the disabler.

BRIEF DESCRIPTION OF THE DRAWINGS

The accompanying figures, in which like reference numerals refer to identical or functionally similar elements throughout the separate views and which are incorporated in and form a part of the specification, further illustrate the present invention and, together with the background of the invention, brief summary of the invention, and detailed description of the invention, serve to explain the principles of the present invention.

DETAILED DESCRIPTION

The particular values and configurations discussed in these non-limiting examples can be varied and are cited merely to illustrate at least one embodiment and are not intended to limit the scope thereof. In general, the figures are not to scale.

A stacked ordnance device provides a disposable and non reusable projectile weapon for passive area defense or denial. A stacked ordnance device has multiple projectiles and charges positioned sequentially in a barrel. A sensing module triggers a control module to enter a firing sequence. The firing sequence is the order and timing by which an electronic ignition system ignites firing charges and thereby shoots the projectiles. A mount positions the stacked ordnance device. The controller can also trigger a disabler that renders the stacked ordnance device unfit for subsequent use.

In 1860, Lindsay (U.S. Pat. No. 30,332) disclosed a handgun having two stacked projectiles. Lindsay's firearm, however, was easily bested in the marketplace by Colt's revolvers. Recent developments have rekindled interest in stacked projectile firearms. Broyles (U.S. Pat. No. 3,854,231) discloses an electronically fired stacked projectile rifle. Electronic firing provides a far better way to ignite firing charges than the multiple flash holes used previously. O'Dwyer (U.S. Pat. No. 6,715,398 B2) also discloses an electronically fired stacked projectile firearm. O'Dwyer focused on the issues of chain firing and charge compaction. As such, stacked ordnance firearms have a long history that has provided a reliable barrel assembly with an electronic ignition system.

A passive area defense and denial primarily occurs in one of two situations. In one situation, an area is uncontrolled by a friendly force that distributes defensive devices such as mines that deny the area to everyone. The result is that almost no one casually enters the area and the various forces are often warned whenever the mined area is traversed. In another situation a friendly force, such as a special operations unit, is traversing unfriendly territory and desires to slow, stop, or eliminate a pursuing force. Mines and explosives can be advantageously employed to slow the pursuit. Directed projectile fire, however, deceives the pursuit into believing that they have contacted the friendly force. Stacked ordnance devices are ideal because they can be placed quickly, be left unattended, produce directed fire, and can not be reused.

Figure 1:
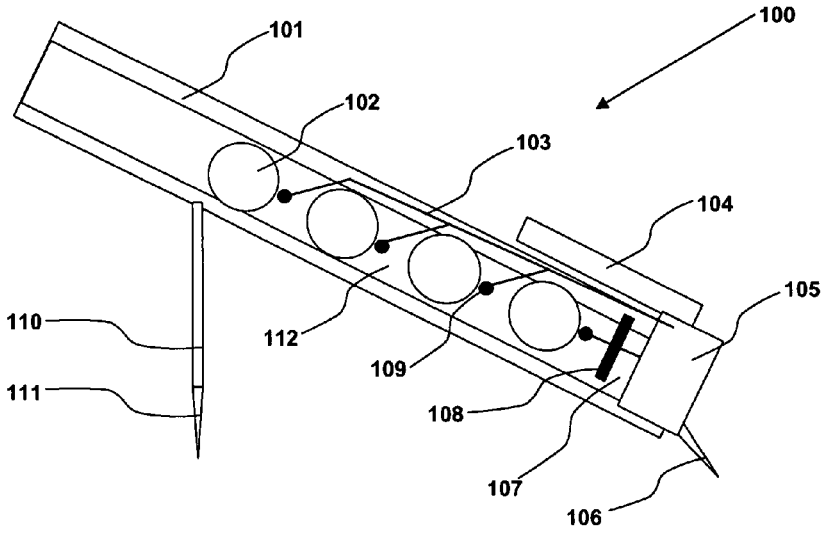
FIG. 1 illustrates a stacked ordnance device in accordance with aspects of the embodiments.

FIG. 1 illustrates a stacked ordnance device 100 in accordance with aspects of the embodiments. A barrel 101 is loaded with multiple projectiles 102 and firing charges 112. An ignition system with igniters 109 and wiring 103 ignites the firing charges 112. A control module 105 controls the sequence in which the igniters 109 ignite. A sensing module 104 senses external stimuli and triggers the control module.

An important characteristic of the stacked ordnance device is that it can not be harvested and reused. A disabler 107 is positioned between a firewall 108 and the control modules 105. The control module 105 activates the disabler 107. The disabler can be a small charge that destroys the back end of the stacked ordnance device or can be a large charge that blows up the entire device as well as anything proximate to it. The disabler can be a chemical packet that is ruptured to melt, dissolve, or clog the device.

The stacked ordnance device 100 can be stuck to a tree, building, vehicle, or the ground by a mount. A tripod mount can have legs 110 tipped with spikes 111. A spike mount 106 can be deployed from the device 100 and stuck into a solid surface.

Figure 2:
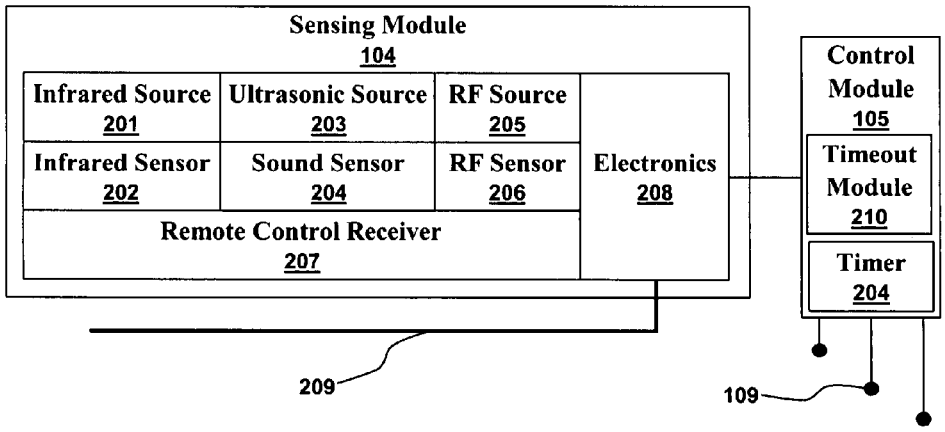
FIG. 2 illustrates a high level block diagram of a sensing module and a control module in accordance with aspects of the embodiments.

FIG. 2 illustrates a high level block diagram of a sensing module 104 and a control module 105 in accordance with aspects of the embodiments. The sensing module 104 can have a variety of sensors. An infrared sensor 202 can detect heat emitted from a person or vehicle. A sound sensor 204 can detect the noise of movement or the reflections of sound waves produced by an ultrasonic source 203. A radio frequency (RF) sensor 206 can detect radio waves or radar signals. Radio waves and radar signals can emanate from or be reflected by a target. An RF source 205 can provide the radio waves or radar signals that get reflected. Similarly, and infrared source 201 can provide infrared illumination for the infrared sensor 202. As is notoriously well known, radio, radar, and infrared refer to certain frequency bands of electromagnetic radiation.

A trip wire 209 can be used to detect when an adversary is very close. In fact, a spike 106 can be used as a trip wire such that pulling the stacked ordnance device 100 also pulls the spike 106 causing a stimulus to the sensing module 104.

A remote control receiver 207 can be used to activate or deactivate the stacked ordnance device 100. When inactive, the device 100 is safe to carry and deploy. When activated, the device 100 is awaiting a stimulus that causes it to blow up or fire a projectile. The remote control receiver can also receive a signal that causes the disabler to active and render the device useless.

Electronics 208 in the sensor module 104 can process sensor outputs and trigger the control module 105 to energize an igniter 109. The control module 105 can contain a timer 204 that controls the timing sequence of energizing the igniters 109.

The stacked ordnance device can include a timeout module 210 that disables the device after a period of time has elapsed. Unexploded mines are a significant problem in today's world. A timeout module 210 can help prevent a stacked ordnance device from becoming a deadly surprise for future generations. A timeout module 210 can use a timer 204 and create a timeout signal after a timeout period has elapsed. The timeout period can be set in the field or can be a default value. After the timeout period elapses, the timeout signal causes the device to disable itself. The device can disable itself by deactivating the ignition system or by activating the disabler. For example, the stacked ordnance device can be enabled and deployed with a six month timeout period. Six months after being deployed, the timeout module 210 produces a timeout signal that triggers the disabler. The timeout module 210 can include a clock and a timeout date. As such, the timeout module can produce a timeout signal at a specific time on a specific day.

Figure 3:
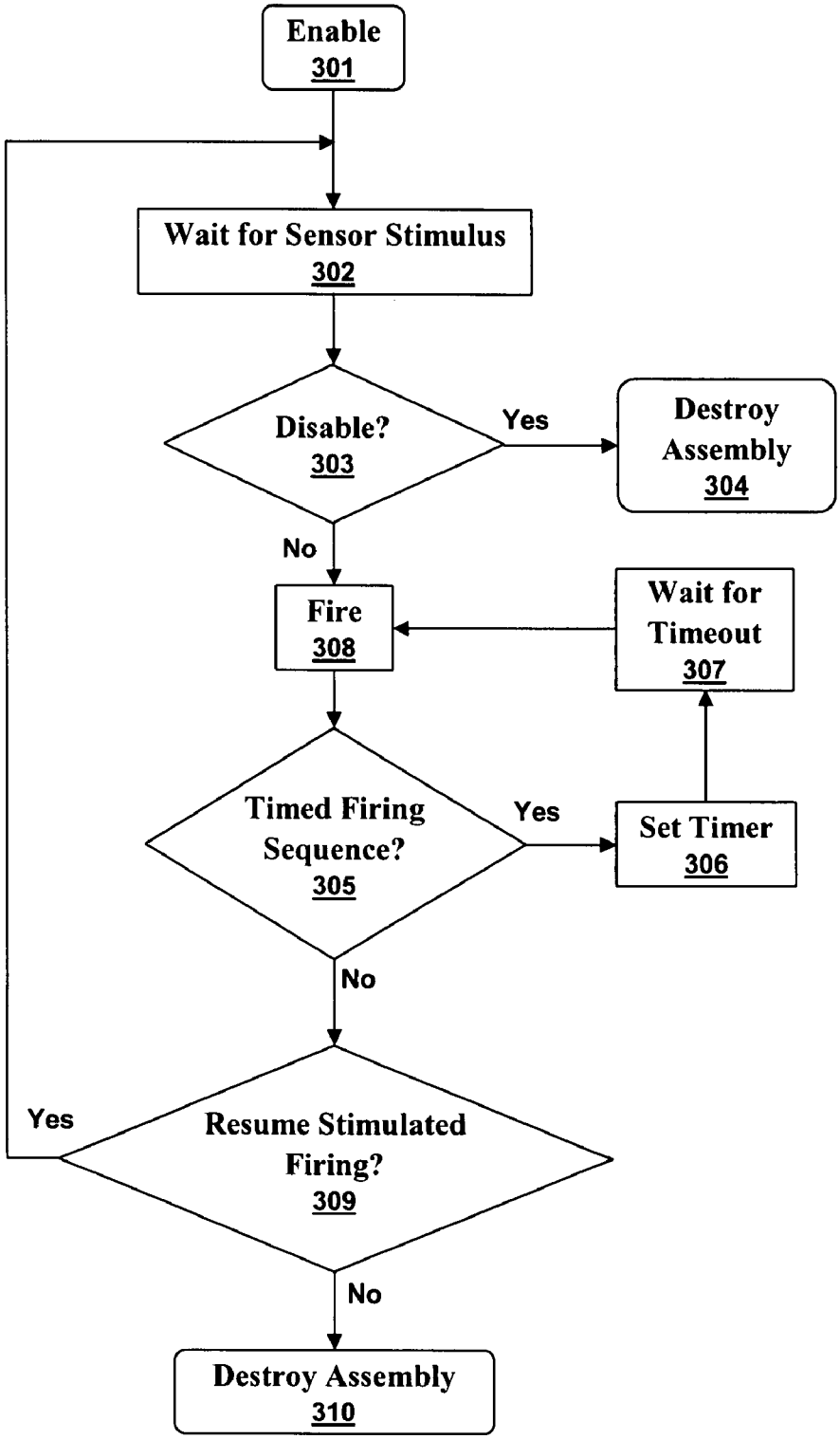
FIG. 3 illustrates a high level flow diagram of a control loop in accordance with aspects of the embodiments.

FIG. 3 illustrates a high level flow diagram of a control loop in accordance with aspects of the embodiments. After being enabled 301 the device waits for sensor stimulus 302. The types of stimulus include infrared, radio, radar, light, sound, trip wires, vibration, and remote commands received by a remote control receiver.

If the stimulus indicates that the device should be disabled 303, then the controller can activate the disabler to destroy the assembly 304. For example, a trip wire can cause a device with a heavy disabling charge blow up as if it were a mine. Other stimuli indicate that a projectile should be fired 308. If the device uses a timed firing sequence 305, then a timer is set 306. When the timer times out 307, another projectile is fired 308. A timed firing sequence fires projectiles at certain time intervals. An example sequence is to fire, wait 1 second, fire, wait 30 seconds, fire, then exit the sequence.

A timed firing sequence can be exited 305 when there is no sequence to use, a complete sequence has been run, or there are no remaining projectiles. The device can resume stimulated firing 309 if there are unfired projectiles. If not, then the disabler can be activated to destroy the stacked ordnance device 310.

Figure 4:
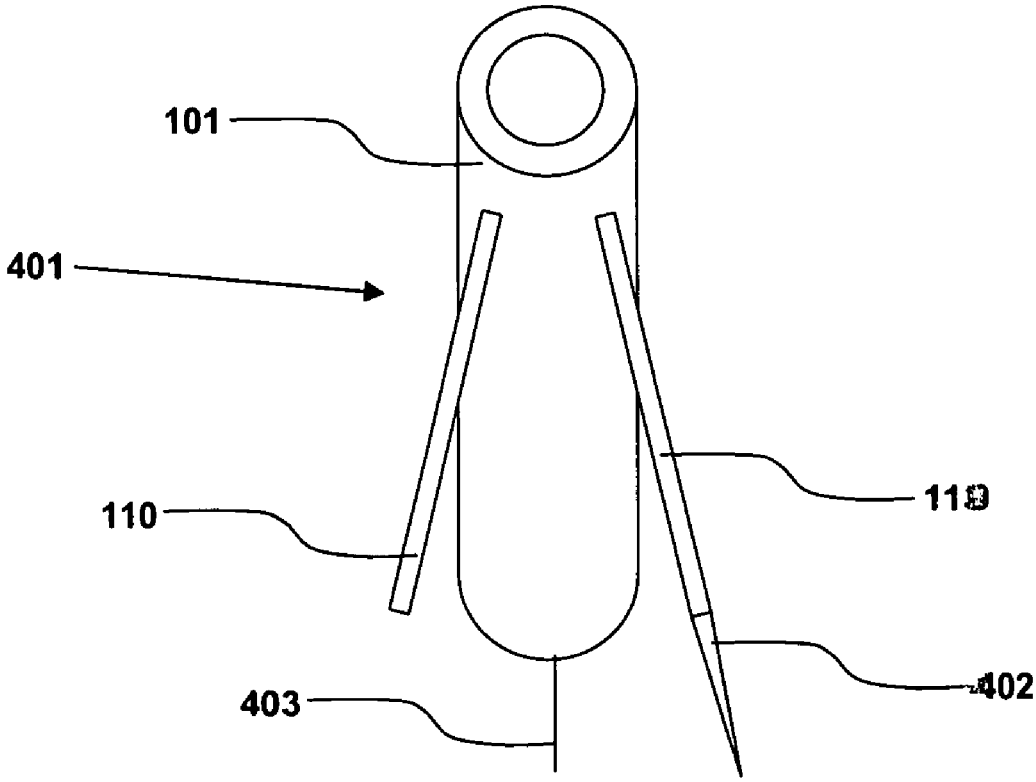
FIG. 4 illustrates a stacked ordnance device with and offset pin in accordance with aspects of the embodiments.

FIG. 4 illustrates a stacked ordnance device with and offset pin in accordance with aspects of the embodiments. The mount is a tripod 401 attached to the barrel 101. The tripod has two legs 110. One of the legs has a spike 402. As can be seen, the spike 402 is an offset pin because it pins the stacked ordnance device to the ground is offset from the barrel center line 403. Firing a projectile causes recoil. The recoil can cause the stacked ordnance device to rotate around the offset pin 402.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A system comprising:

a stacked ordnance barrel assembly comprising a barrel, a plurality of projectiles, a plurality of firing charges, and an electronic ignition system;

a disabler that renders the stacked ordnance barrel assembly unfit for future operation;

a mount;

a control module wherein the control module causes the ignition system to ignite the firing charges and to activate the disabler; and a sensing module that detects at least one stimulus and triggers the control module.

2. The system of claim 1 wherein the sensing module detects infrared radiation.

3. The system of claim 1 wherein the sensing module detects sound.

4. The system of claim 1 wherein the sensing module comprises a trip wire.

5. The system of claim 1 wherein the sensing module emits and detects ultrasonic sound.

6. The system of claim 1 wherein the sensing module emits and detects electromagnetic radiation.

7. The system of claim 1 wherein the control module causes at least two firing charges to ignite in a timed sequence.

8. The system of claim 1 wherein the mount comprises a tripod.

9. The system of claim 1 wherein the mount comprises an offset pin.

10. The system of claim 1 further comprising a remote control receiver.

11. A system comprising:

a stacked ordnance barrel assembly comprising a barrel, a plurality of projectiles, a plurality of firing charges, and an electronic ignition system;

a disabler that renders the stacked ordnance barrel assembly unfit for future operation;

a mount comprising at least one spike;

a control module wherein the control module causes the ignition system to ignite the firing charges and to activate the disabler; and a sensing module that detects at least one stimulus and triggers the control module.

12. The system of claim 11 wherein the sensing module emits and detects ultrasonic sound.

13. The system of claim 11 wherein the sensing module emits and detects electromagnetic radiation.

14. The system of claim 11 wherein the control module causes at least two firing charges to ignite in a timed sequence.

15. The system of claim 11 further comprising:

a remote control receiver; and a timeout module that disables the system after a time period elapses;

wherein the sensing module emits and detects ultrasonic sound;

wherein the control module causes at least two firing charges to ignite in a timed sequence;

wherein the mount further comprises a tripod and an offset pin; and wherein the sensing module comprises a trip wire.

16. A system comprising:

a stacked ordnance barrel assembly comprising a barrel, a plurality of non-lethal projectiles, a plurality of firing charges, and an electronic ignition system;

a disabler that renders the stacked ordnance barrel assembly unfit for future operation;

a mount;

a control module wherein the control module causes the ignition system to ignite the firing charges and to activate the disabler; and a sensing module that detects at least one stimulus and triggers the control module.

17. The system of claim 16 wherein at least one of the non-lethal projectiles is a pepper ball.

18. The system of claim 16 wherein at least one of the non-lethal projectiles is a paint ball.

19. The system of claim 16 wherein at least one of the non-lethal projectiles is a bean bag.

20. The system of claim 16 further comprising:

a remote control receiver;

wherein the mount comprises a tripod and further comprising at least one spike;

wherein the control module wherein the control module causes at least two firing charges to ignite in a timed sequence; and wherein the plurality of non-lethal projectiles comprises at least one pepper ball.

* * * * *